US010766655B2

(12) United States Patent
Ehrmann et al.

(10) Patent No.: US 10,766,655 B2
(45) Date of Patent: Sep. 8, 2020

(54) THERMOFORM PACKAGING MACHINE WITH FILM PUNCH

(71) Applicant: MULTIVAC Sepp Haggenmüller SE & Co. KG, Wolfertschwenden (DE)

(72) Inventors: Elmar Ehrmann, Bad Grönenbach (DE); Robert Maier, Babenhausen (DE)

(73) Assignee: Multivac Sepp Haggenmüller SE & Co. KG, Wolfertschwenden (DE)

( * ) Notice: Subject to any disclaimer, the term of this patent is extended or adjusted under 35 U.S.C. 154(b) by 635 days.

(21) Appl. No.: 15/187,493

(22) Filed: Jun. 20, 2016

(65) Prior Publication Data

US 2016/0376048 A1 Dec. 29, 2016

(30) Foreign Application Priority Data

Jun. 23, 2015 (DE) ..... 10 2015 211 622

(51) Int. Cl.
*B65B 61/06* (2006.01)
*B26D 5/00* (2006.01)
(Continued)

(52) U.S. Cl.
CPC ..... *B65B 61/065* (2013.01); *B26D 5/00* (2013.01); *B26D 5/005* (2013.01); *B26D 5/086* (2013.01);
(Continued)

(58) Field of Classification Search
CPC ..... B65B 61/065; B65B 47/00; B26D 5/00; B26D 5/005; B26D 5/086; B26D 5/18; B26F 1/14; B26F 1/44; B26F 2001/4463
See application file for complete search history.

(56) References Cited

U.S. PATENT DOCUMENTS 3,411,345 A * 11/1968 Wintriss ..... B30B 15/0094 100/99
4,942,795 A * 7/1990 Linke ..... B23D 47/12 83/403.1
(Continued)

FOREIGN PATENT DOCUMENTS

DE 3436469 C1 9/1985
DE 8429209 U1 7/1986
(Continued)

OTHER PUBLICATIONS

Sales Order 300006672, Order Date Apr. 24, 2013, Delivered to Nurnberger Bratwurst GmbH, Andernacher Str. 29, Nurnberg, 90411, Purchase Order Nr. 045037 0976, pp. 1-4. (This document was originally presented in the German language in a European opposition proceeding against European Patent No. EP3109017; the English translation has been attached hereto. European Patent No. EP3109017 is related to this U.S. Appl. No. 15/187,493. This document and its date have not been authenticated as of the filing date of this IDS.).
(Continued)

*Primary Examiner* — Omar Flores Sanchez
(74) *Attorney, Agent, or Firm* — Husch BLackwell LLP

(57) ABSTRACT

The present invention relates to a thermoform packaging machine, comprising a controller and a film punch, which includes a lever mechanism, a tool, upper part and a tool lower part. At least one of the tool upper part and the tool lower part are movable by means of the lever mechanism such that the tool upper part and the tool lower part approach each other.

13 Claims, 6 Drawing Sheets

(51) Int. Cl.

| | |
|---|---|
| ***B26F 1/44*** | (2006.01) |
| ***B26D 5/08*** | (2006.01) |
| ***B65B 47/00*** | (2006.01) |
| ***B26D 5/18*** | (2006.01) |
| ***B26F 1/14*** | (2006.01) |

(52) U.S. Cl.

CPC ..... *B26D 5/18* (2013.01); *B26F 1/14* (2013.01); *B26F 1/44* (2013.01); *B65B 47/00* (2013.01); *B26F 2001/4463* (2013.01)

(56) References Cited

U.S. PATENT DOCUMENTS

| | | | | |
|---|---|---|---|---|
| 5,027,631 | A * | 7/1991 | Naito | B21D 28/002 700/160 |
| 5,953,972 | A * | 9/1999 | Nakagawa | B21D 28/002 83/72 |
| 7,631,528 | B2 * | 12/2009 | Iwashita | B21D 24/02 72/20.1 |
| 7,685,860 | B2 * | 3/2010 | Iwashita | B21D 24/02 72/1 |
| 2003/0066323 | A1 | 4/2003 | Teraoka | |
| 2005/0274243 | A1 * | 12/2005 | Shiroza | B21D 24/10 83/13 |

FOREIGN PATENT DOCUMENTS

| | | | |
|---|---|---|---|
| DE | 3604255 | A1 | 8/1987 |
| DE | 8813774 | U1 | 4/1990 |
| DE | 4117542 | A1 | 12/1992 |
| DE | 69105801 | T2 | 7/1995 |
| DE | 19536725 | A1 | 4/1997 |
| DE | 19607836 | C1 | 9/1997 |
| DE | 19841415 | A1 | 3/2000 |
| DE | 10327092 | A1 | 12/2004 |
| DE | 10351567 | A1 | 6/2005 |
| DE | 102004008597 | A1 | 9/2005 |
| DE | 102007024710 | A1 | 11/2008 |
| DE | 102010019576 | A1 | 11/2011 |
| DE | 102011052860 | A1 | 3/2012 |
| DE | 102012023665 | A1 | 6/2014 |
| DE | 102014210963 | A1 | 12/2015 |
| DE | 102012101952 | B4 | 3/2016 |
| EP | 741001 | A2 | 11/1996 |
| EP | 1118540 | B1 | 12/2005 |
| EP | 1612037 | A2 | 1/2006 |
| EP | 1537988 | B1 | 2/2009 |
| EP | 2586590 | A1 | 5/2013 |
| EP | 2586591 | B1 | 3/2015 |
| EP | 2860119 | A1 | 4/2015 |
| EP | 2746167 | B1 | 7/2015 |
| EP | 1988024 | B2 | 5/2017 |
| IE | 02009056169 | A1 | 6/2011 |
| WO | 2007144210 | A1 | 12/2007 |
| WO | 2008046471 | A1 | 4/2008 |
| WO | 2014206848 | A2 | 12/2014 |

OTHER PUBLICATIONS

Order Data PowerPak RT, CFS Germany, Project No. 311 000 322, Thermoformer-Powerpak RT-Type 3-GB 560, printed May 8, 2013, pp. 1-2. (This document was originally presented in the German language in a European opposition proceeding against European Patent No. EP3109017; the English translation has been attached hereto. European Patent No. EP3109017 is related to this U.S. Appl. No. 15/187,493. This document and its date have not been authenticated as of the filing date of this IDS).

Transport Order of Powerpak PP RI 520, Machine No. 35200120, Customer: GEA Food Solutions Germany GmbH, Sep. 5, 2013, pp. 1-6. (This document was originally presented in the German language in a European opposition proceeding against European Patent No. EP3109017; the English translation has been attached hereto. European Patent No. EP3109017 is related to this U.S. Appl. No. 15/187,493. This document and its date have not been authenticated as of the filing date of this IDS.).

An undated CAD drawing of a packaging machine,1 page. (This document was originally presented in the German language in a European opposition proceeding against European Patent No. EP3109017; the English translation has been attached hereto. European Patent No. EP3109017 is related to this U.S. Appl. No. 15/187,493. This document and its date have not been authenticated as of the filing date of this IDS.).

GEA Food Solutions GmbH Report of Customer Wolf, Machine No. 35200120 printed May 8, 2013, 1 page. (This document was originally presented in the German language in a European opposition proceeding against European Patent No. EP3109017; the English translation has been attached hereto. European Patent No. EP3109017 is related to this U.S. Appl. No. 15/187,493. This document and its date have not been authenticated as of the filing date of this IDS.).

A CAD drawing appearing to show Item No. 3000199657 and having a date of Aug. 8, 2011, 1 page. (This document was originally presented in the German language in a European opposition proceeding against European Patent No. EP3109017; the English translation has been attached hereto. European Patent No. EP3109017 is related to this U.S. Appl. No. 15/187,493. This document and its date have not been authenticated as of the filing date of this IDS.).

Circuit Diagram No. E-2006, Machine No. 35200120, created Nov. 10, 2011, pp. 1-2. (This document was originally presented in the German language in a European opposition proceeding against European Patent No. EP3109017; the English translation has been attached hereto. European Patent No. EP3109017 is related to this U.S. Appl. No. 15/187,493. This document and its date have not been authenticated as of the filing date of this IDS.).

GEA FS Germany GmbH Handover Protocol, Order Nos. 300006672 and 340003517, Sep. 12, 2013. (This document was originally presented in the German language in a European opposition proceeding against European Patent No. EP3109017; the English translation has been attached hereto. European Patent No. EP3109017 is related to this U.S. Appl. No. 15/187,493. This document and its date have not been authenticated as of the filing date of this IDS.).

Source Code Package F_Cuting, File X_Punchservo.st created Aug. 9, 2011, pp. 1-17. (This document was originally presented in a European opposition proceeding against European Patent No. EP3109017. European Patent No. EP3109017 is related to this U.S. Appl. No. 15/187,493. This document and its date have not been authenticated as of the filing date of this IDS.).

* cited by examiner

THERMOFORM PACKAGING MACHINE WITH FILM PUNCH

CROSS-REFERENCE TO RELATED APPLICATIONS

This Application claims priority to German Patent Application Number 102015211622.0 filed Jun. 23, 2015, to Elmar Ehrmann and Robert Maier, currently pending, the entire disclosure of which is incorporated herein by reference.

FIELD OF THE INVENTION

The present invention relates to a thermoform packaging machine as well as to a method comprising the features of the machine.

BACKGROUND OF THE INVENTION

DE 198 41 415 A1 discloses a film punch suitable for cutting plastic films/foils by means of a knife and a counter knife. A lift drive including a linear motor is provided. The lift drive includes a means of an articulated lever arrangement in combination with a straightening lever arrangement comprising together a large number of mechanical levers. Forces which are effective for cutting the film can increase rapidly and towards the end of the punching stroke, the increase of these forces becomes less steep. This is advantageous insofar as the film punch is intended to be suitable for reliably cutting different film/foil thicknesses without complicated knife adjustment operations being necessary.

The prior art discloses a film punch, type FS 08, produced by the applicant's company (see FIG. 1), which comprises a pneumatic cylinder as a lifting mechanism drive and which cuts through a film web by means of a squeeze knife and a counter-pressure bar. In order to reduce the load on and the wear of the squeeze knifes as far as possible when they come into contact with the counter-pressure bar and in order to be nevertheless able to cut through thick films/foils, the counter-pressure bar is provided with a fine adjustment device so that the counter-pressure bar can be adjusted with an accuracy of at least 0.02 mm relative to the end position of the squeeze knife.

As the squeeze knife is operated over time, the cutting edge of the squeeze knife dulls and the counter-pressure bar and/or the squeeze knife must be readjusted in order to guarantee a reliable, high-quality cut through of the film so as to ensure reliable processing. When such a film punch is used on thermoform packaging machines, the squeeze knifes, and perhaps also the counter-pressure bar, are often replaced in the case of a change of format, and, subsequently, the counter-pressure bar and the squeeze knife, respectively, have to be newly adjusted. This is done in a first test phase, with the thermoform packaging machine running, and requires a certain effort until cutting or cutting through of the film is accurately adjusted.

The load on the squeeze knife caused by the contact with the counter-pressure bar during each cutting or squeezing process may be very high, as can be seen from the time-force diagram according to FIG. 2. In order to be able to establish this kind of diagram, pressure sensors were provided in the area of the fine adjustment device in an experimental set-up, so as to detect the load on the counter-pressure bar and the squeeze knife, respectively. The diagram shows that, after cutting through of the film at the moment in time t2, the force increases still further, since the pneumatic cylinder with its force, which can be generated through the pressure applied, presses the squeeze knife and the counter-pressure bar against one another. In the exemplary case shown, this force F1 is more than twice as strong as would be necessary for the cutting process. A fundamental reduction of the pressurized air supply to the pneumatic cylinder is, however, not desired, since, if the pressure were for example halved, this would also lead to a reduction of the speed of the lift drive, whereby the performance per work cycle of the film punch would be reduced. The reduced speed with which the squeeze knife impacts the film also has a negative influence on the cutting quality when the film is being cut through.

SUMMARY OF THE INVENTION

It is one object of the present invention to improve a thermoform packaging machine including a film punch with respect to a longer service life of the tools and an easier adjustment of the tools relative to one another in the case of tool changing.

The thermoform packaging machine according to one embodiment of the present invention comprises a controller and a film punch, which includes a lever mechanism, a tool upper part and a tool lower part. The tool upper part and/or the tool lower part are movable by means of the lever mechanism such that the tool upper part and the tool lower part approach each other. In the thermoform packaging machine, according to one embodiment, the film punch comprises a servo drive. A measuring unit may be provided, which is configured to detect the contact between the tool upper part and the tool lower part. With regard to this contact position of the movable tool, for example, through a calibration procedure, the end position of the movable tool which is most suitable for the punching process and thus the position of the two tools relative to one another can be ascertained in the controller and can then be accessed and established during the subsequent punching processes. Due to the accurate end position of the movable tool, unnecessarily higher forces or loads on the squeeze knife will no longer occur.

The controller may be connected to the measuring unit, and the position of the tool upper part and of the tool lower part at the working position can be calculated by means of the controller. This supports a fully automated calibration mode. An additional option provided is the possibility of configuring the lower position and the open tool position, respectively, such that they can be changed by the operator and can also be stored in programs so as to reduce unnecessary lifting movements, for example, in the case of small package depths.

According to one embodiment, the measuring unit is a governor of the servo drive, so that, on the basis of current consumption over time, namely during the calibration movement of the movable tool, the working position can be detected and evaluated, since, at the point where the tools come into contact with one another, the current consumption will increase strongly and it may also exhibit other characteristic features.

Alternatively, the measuring unit can be a pressure sensor or an impact-sound or vibration sensor for detecting the pressure between the tool upper part and the tool lower part. The impact-sound sensor or the vibration sensor are preferably suitable for detecting, through the suddenly occurring impact, the collision of the two tools and for detecting the resultant vibration.

The servo drive may comprise a servomotor with a governor and a spindle, for example a ball screw, for positioning the movable tool with high speed in combination with high accuracy.

A method according to one embodiment of the present invention used for determining the working position, in particular the working position of the tool lower part of the film punch, is characterized in that the tool lower part and the tool upper part are caused to approach each other, and that the contact between the tools is ascertained by means of the controller on the basis of an evaluation of data of the measuring unit.

The measuring unit can be a governor for a servomotor of the servo drive, and, on the basis of the current consumption of the servomotor, the force progression of the force acting on the movable tool may be detected. Hence, a suitable position, namely an end position, can be ascertained in the controller in an automated manner on the basis of the current profile over time with simultaneous detection of the position of the tools relative to one another.

Alternatively, the measuring unit may be a pressure sensor and a measurement of force is carried out at a tool.

According one embodiment, the controller calculates an end position for the movable tool, so that the forces produced during the punching process will not be (substantially) higher than the forces required for the punching process, so as to extend the service life of the tools.

Other and further objects of the invention, together with the features of novelty appurtenant thereto, will appear in the course of the following description.

DESCRIPTION OF THE SEVERAL VIEWS OF THE DRAWING

In the following, an advantageous embodiment of the thermoform packaging machine according to the present invention and of the method according to the present invention will be explained in more detail making reference to a drawing. The individual figures show.

Like components are provided with like reference numerals throughout the figures.

DETAILED DESCRIPTION OF THE INVENTION

Figure 1:
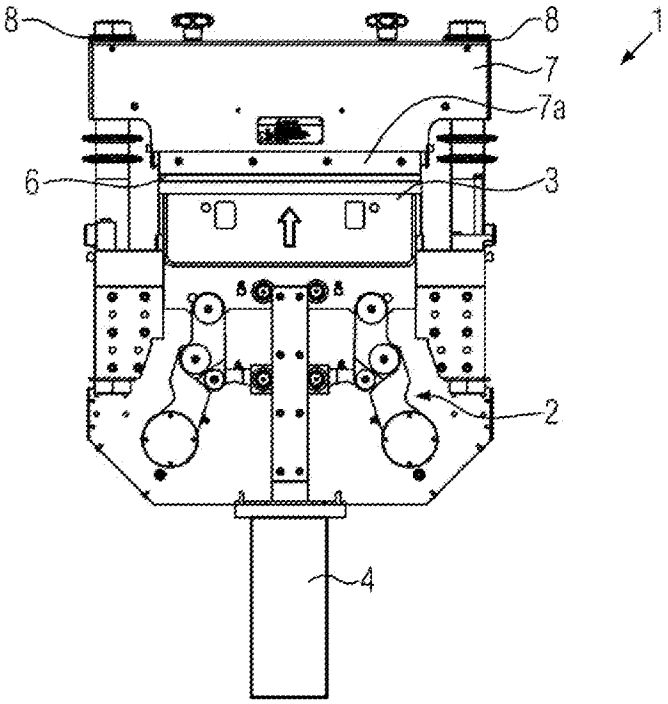
FIG. 1 (Prior Art)
FIG. 1 is a sectional view of a film punch according to the prior art.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

FIG. 1 shows, in a sectional view, a film punch 1 according to the prior art, comprising a lever mechanism 2 for allowing a tool lower part 3 to be moved vertically upwards. A pneumatic cylinder 4 is used as a drive for the lever mechanism 2. The lever mechanism 2 transmits the movement of a piston of the pneumatic cylinder 4 to the tool lower part 3. The lift and the force of the tool lower part 3 are determined by the structural design of the lever mechanism 2. The tool lower part 3 is shown at its maximum upper position in FIG. 1. At this position, a counter-pressure bar 6 of the tool lower part 3 is in contact with a knife 7*a* of a tool upper part 7. In order to allow an adjustment of the pressure, which the counter-pressure bar 6 applies to the knife 7*a*, the film punch 1 comprises adjustment wheels 8, so that the knife 7*a* can be adjusted with an accuracy of a few 1/100 millimeters with respect to its height and thus relative to the counter-pressure bar 6 of the tool lower part 3. Due to the constant contact of the knife 7*a* with the counter-pressure bar 6 after cutting through of a film/foil, the cutting edge of the knife 7*a* blunts and the knife 7*a* must be displaced downwards for still achieving a good punching and cutting result. Misadjustments may have a strongly negative effect on the service life of the knife 7*a* and the counter-pressure bar 6.

Figure 2:
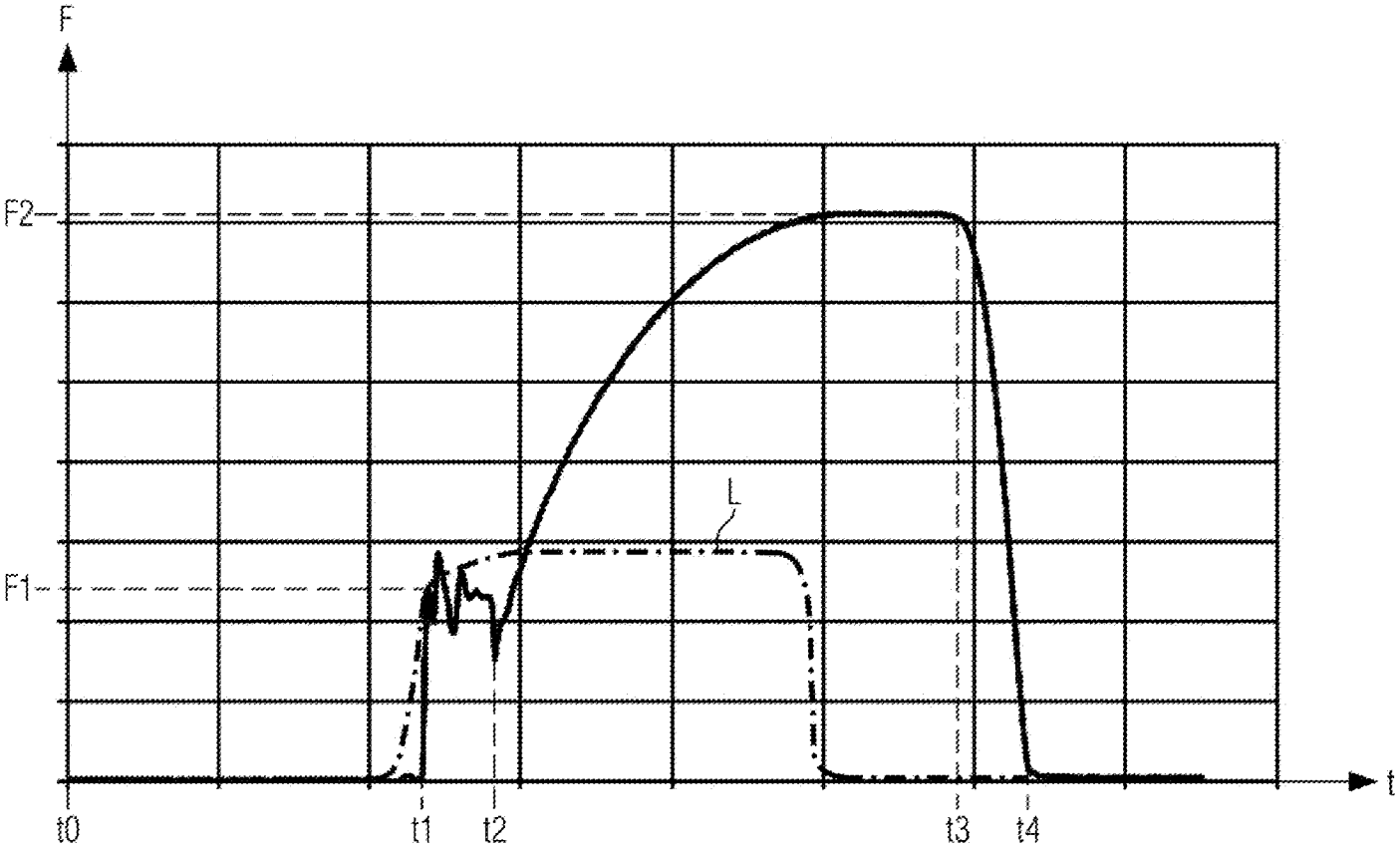
FIG. 2 is a time-force diagram of the conventional film punch and of a film punch according to one embodiment of the present invention.

FIG. 2 shows the force progression of the pressure F applied by the counter-pressure bar 6 to the knife 7*a*, on the basis of a time-force diagram with a solid line, taking the film punch 1 according to FIG. 1 as an example. At the moment in time t0, the tool lower part 3 is at the lower initial position, at which the pneumatic cylinder 4 is fully retracted. The pneumatic cylinder 4 has then pressure applied thereto and moves the tool lower part 3 upwards up to the film to be cut. At t1, the counter-pressure bar 6 of the tool lower part 3 meets the film and presses the film with a force F1 against the knife 7*a*. t2 represents the moment at which the knife penetrates into and passes through, i.e., cuts through, the film. Subsequently, the knife 7*a* is in contact with the counter-pressure bar 6 and the force F increases to a maximum value F2, which is influenced by the pneumatic cylinder 4 and its pressurized air supply and also by the upper end position of the pneumatic cylinder. At t3, the punching process comes to an end and the pressure of the pneumatic cylinder 4 is no longer applied and, consequently, the pressure F will decrease up until t4. From the moment t4 onwards, the tool lower part 3 and the counter-pressure bar 6 move away from the knife 7*a* and return to the initial position.

As can be seen from the diagram, the force F1 required for cutting the film is less than half the maximum occurring force F2 with which the counter-pressure bar 6 still acts on the knife 7*a* after the cutting process. For a direct comparison with the prior art, the force progression according to one embodiment of the present invention is shown as a dot-and-dash line L. With reference to the figures following herein below, it will be explained in more detail how this force progression is accomplished.

Figure 3:
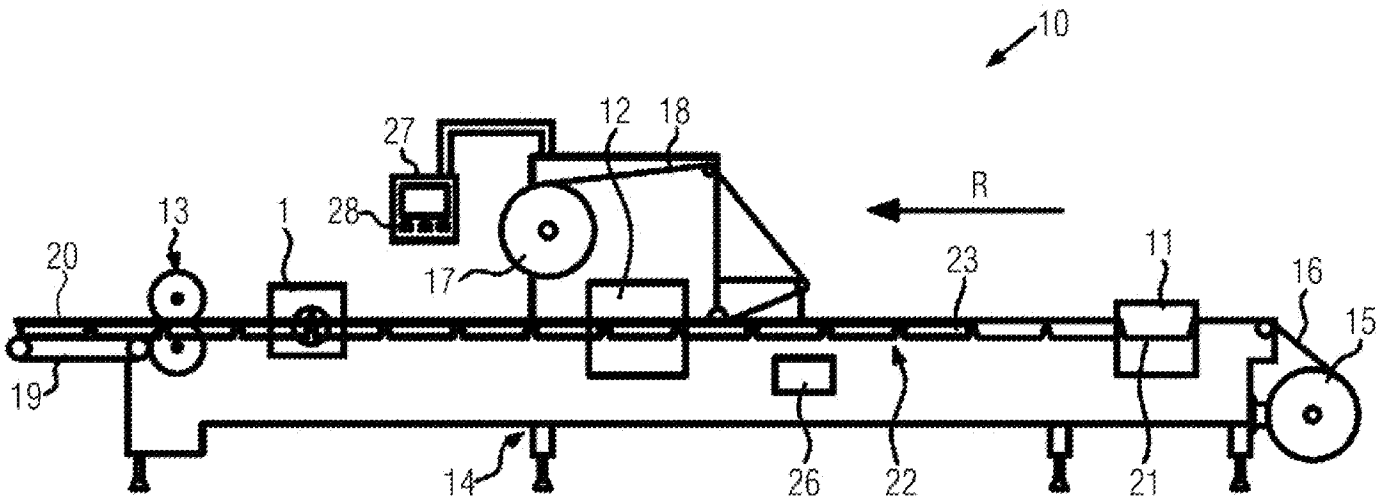
FIG. 3 is a schematic side view of a thermoform packaging machine according to one embodiment of the present invention.

FIG. 3 shows a schematic side view of a thermoform packaging machine 10 according to one embodiment of the present invention. The thermoform packaging machine 10 may comprise a forming station 11, a sealing station 12, a transverse cutting unit in the form of a film punch 1 and a longitudinal cutting unit 13, which are arranged in this order in a production direction Ron a machine frame 14. On the input side, a supply roll 15 can be provided on the machine frame 14, from which a film web 16 is unwound. In the area of the sealing station 12, a material storage unit 17 may be provided, from which a cover film 18 is unwound. On the output side, a discharge device 19 in the form of a conveyor belt can be provided at the thermoform packaging machine 10, with which finished, singulated packages 20 are transported away. Furthermore, the thermoform packaging machine 10 may comprise a feeding device, which grips the film web 16 and advances it in the production direction R during each main work cycle. The feeding device may include, for example, clamp chains arranged on both sides.

In the embodiment shown, the forming station 11 is configured as a thermoforming station, in which troughs 21 are formed in the film web 16 by thermoforming. The forming station 11 may be configured such that, in the direction perpendicular to the production direction R, several troughs 21 are formed side by side. Downstream of the forming station 11, when seen in the production direction R, an infeed line 22 may be provided, along which the troughs 21 formed in the film web 16 are filled with products 23.

The transverse cutting unit 1 is configured as a film punch cutting through the film web 16 and the cover film 18 in a direction transversely to the production direction R between neighboring troughs 21. In so doing, the film punch 1 may work such that the film web 16 is not cut across the whole width of the film, but remains uncut in at least an edge area thereof. This allows controlled further transport by the feeding device.

In the embodiment shown, the longitudinal cutting unit 13 is configured as a blade arrangement that may comprise a plurality of rotating circular blades by means of which the film web 16 and the cover film 18 are cut through between neighboring troughs 21 and at the lateral edge of the film web 16, so that, downstream of the longitudinal cutting unit 13, singulated packages 20 are obtained.

The thermoform packaging machine 10 may additionally be provided with a controller 26. It has the function of controlling and monitoring the processes taking place in the thermoform packaging machine 10. A display device 27 with operating controls 28 serves to make the sequences of process steps in the thermoform packaging machine 10 visible to an operator and to influence them by the operator.

The film punch 1 and its function will be explained in more detail making reference to the figures following herein below.

Figure 4:
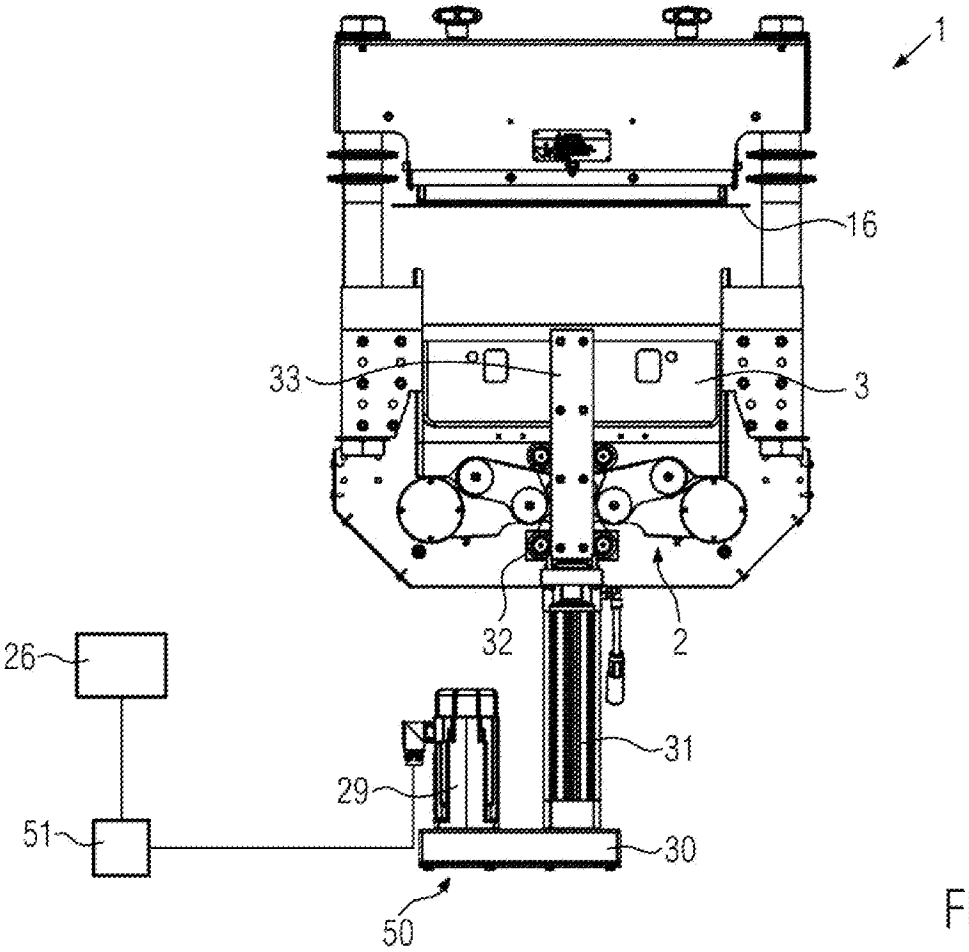
FIG. 4 is a sectional view of a film punch according to one embodiment of the present invention in the production direction at an initial position.

FIG. 4 shows a sectional view of the film punch 1 according to one embodiment of the present invention in the production direction R at an initial position at which the tool lower part 3 is at its lower position. A servomotor 29 can be provided as a drive for the lever mechanism 2, the servomotor 29 transmitting via a belt drive 30 the torque to a spindle 31, such as a ball screw, thus converting the rotation of the motor into a linear movement. The spindle 31 lifts a carriage 32 guided on a vertical guide 33. Alternatively, it is also imaginable to use a linear servo drive instead of the servomotor 29, the belt drive 30 and the spindle 31. The servomotor 29 in combination with the belt drive 30 and the spindle 31 are referred to as servo drive 50. The servo drive 50 can also comprise a governor 51 for the servomotor 29, the governor 51 communicating with the controller 26. Alternatively, a gear drive may be provided instead of the belt drive 30. The servo drive 50 may additionally comprise an incremental encoder or an absolute encoder on the spindle 31 for detecting the linear movement of the spindle 31.

When the carriage 32 moved upwards, a respective toggle lever 34 provided on either side of the guide 33 may be operated and forced apart (see FIG. 5) by means of a lever linkage 35 connecting the carriage 32 to the toggle lever 34. The forcing apart of the respective toggle levers 34 causes a lifting plate 36 to move vertically upwards, since the two toggle levers 34 are each rotatably supported on a frame 39 via a respective lower lever element 37 and on the lifting plate 36 via a respective upper lever element 38. The lifting plate 36 can be vertically guided via rollers 40 by means of the guide 33.

Figure 6:
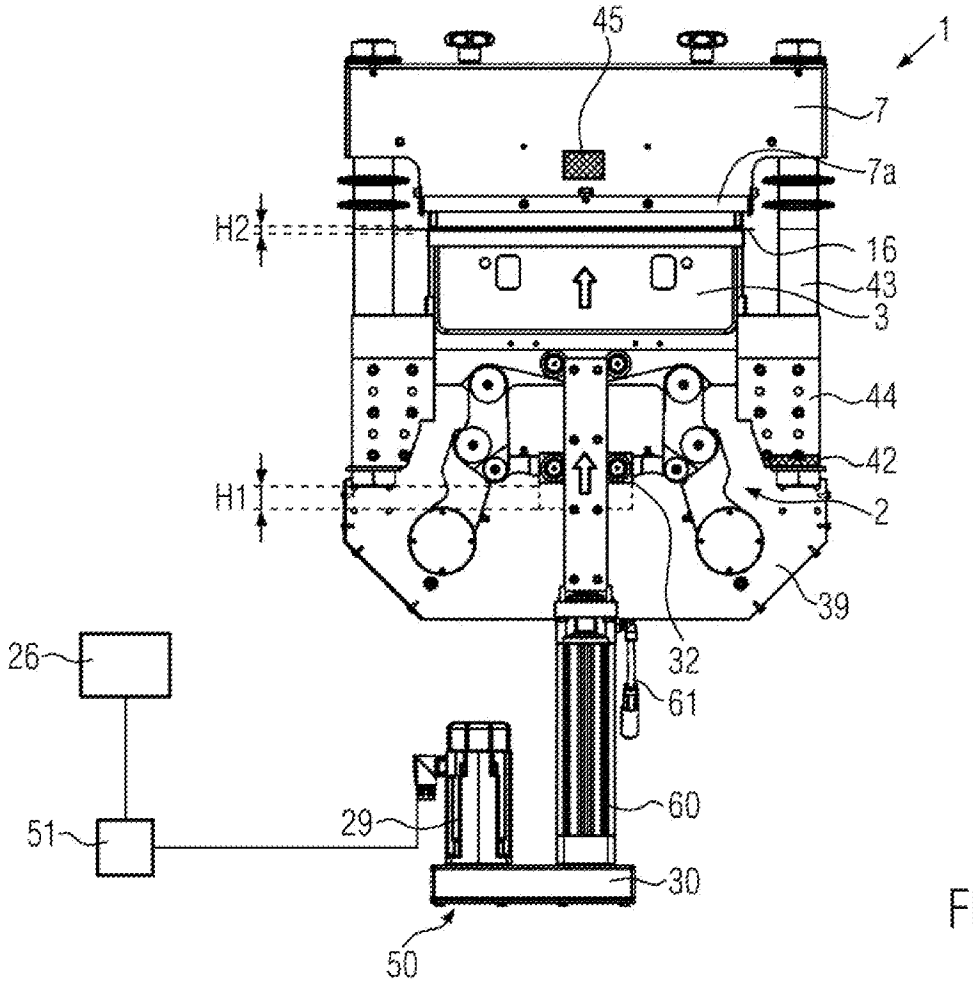
FIG. 6 is a sectional view of the film punch of FIG. 4 at an end position.

FIG. 6 shows the film punch 1 at an end position after the film web 16 has been cut through. Just before this end position, the carriage 32 executes a lift movement H1 of, for example, 20 mm, while the lifting plate 36 executes simultaneously only a lift H2 of, for example, 1 mm in the same direction.

FIG. 6 additionally shows the governor 51 for the servomotor 29, the governor 51 being connected to the controller 26. The governor 51 may detect the motor current of the servomotor 29 and transmits this information to the controller 26. The motor current is approximately proportional to the pressure F, which is shown in the diagram in FIG. 2.

Alternatively or additionally, the pressure may also be detected by a pressure sensor 42 as a measuring unit, the pressure sensor 42 being arranged in the power flow from the lever mechanism 2, the tool upper part 7 and the tool lower part 3, for example, as shown in FIG. 6, between the lower end of a holder 43 for the tool upper part 7 and an accommodation part 44 of the frame 39 for the holder 43. It is also possible to provide two pressure sensors 42 symmetrically on the right and on the left hand side on the holders 43.

According to another alternative embodiment of the measuring unit, a vibration sensor 45 or an impact-sound sensor may be provided on the tool upper part 7, so as to detect the contact or the impact of the tool lower part 3 and the counter-pressure bar 6 with/on the tool upper part 7 and the knife 7*a*.

Figure 5:
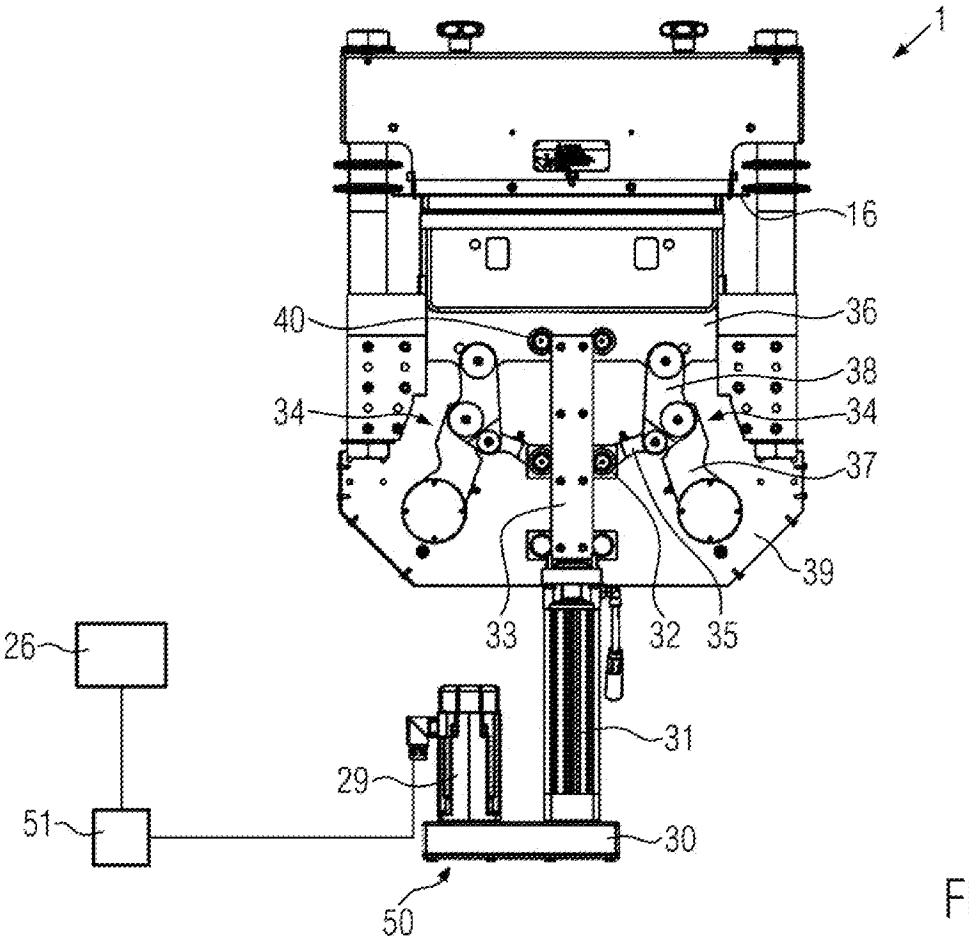
FIG. 5 is a sectional view of the film punch of FIG. 4 at a partially closed position.

For determining the working position, the tool lower part 3 is moved upwards, as shown in FIGS. 4 to 6, up to the tool upper part 7. The speed of travel may here be lower and therefore more gentle than during the rest of the production process. According to one embodiment of the method, a film web 16 is not yet present during this procedure, so that the tool lower part 3 can be moved up to the tool upper part 7 without a cutting force being applied.

In all these cases, the controller 26 may ascertain, on the basis of the detected data of the measuring unit 41, 42 or 45, the end or also the contact position as working position of the tool lower part 3 and of the carriage 32, which corresponds to a specific position of the servomotor 29 and of the spindle 31, respectively. The controller 26 positions the tool lower part 3 for the punching process at the working position, but not further than that. In this way, a force progression L is obtained (see FIG. 2) shown as a dot-and-dash line L in direct comparison with an embodiment according to the prior art. In comparison with the prior art, this force progression has the advantage that the maximum force is hardly higher than the force ensuring that the film is cut through.

The spindle 31 may optionally (see FIG. 6) be provided with a housing 60 with an IP 65 type of protection. A pressure compensation device 61 in the form of a line may be provided, the line being extended outwards to the surroundings. This kind of structural design is particularly hygienic, since the housing 60 is here configured such that it is dustproof and adapted to be cleaned by a water jet.

Instead of a spindle 31, the servo drive 50 may comprise a connecting rod drive.

According to one variant, the knife 7*a* may be provided on the tool lower part 3 and the counter-pressure bar 6 on the tool upper part 7.

The method according to the present invention may be carried out regularly, for example, once a week, once a day or whenever the machine is started. The film punch 1 will then always be adjusted optionally for the subsequent operation, irrespectively of a possible wear of the knife 7*a*. In this way, a manual readjustment or replacement of the cutting tools of the film punch is required much less frequently than in the prior art, whereby the operation of the film punch 1 and of the packaging machine in its entirety is substantially optimized.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A thermoform packaging machine comprising:

a film punch including a servo drive, a lever mechanism, a tool upper part and a tool lower part, wherein at least one of the tool upper part and the tool lower part is movable by the lever mechanism such that the tool upper part and the tool lower part approach each other;

a controller; and a measuring unit configured to detect a contact between the tool upper part and the tool lower part;

wherein the measuring unit is at least one of a pressure sensor, an impact-sound sensor, a vibration sensor, and a governor that detects at least the current of the servo drive or of a servomotor of the servo drive.

2. The thermoform packaging machine according to claim 1, wherein the controller is connected to the measuring unit, and wherein a working position of at least one of the tool upper part and the tool lower part can be calculated by the controller.

3. The thermoform packaging machine according to claim 1, wherein the measuring unit is a governor of the servo drive.

4. The thermoform packaging machine according to claim 1, wherein the servo drive comprises the servomotor, a governor and a spindle.

5. The thermoform packaging machine according to claim 4, wherein the spindle is a ball screw.

6. A method of determining the working position of at least one of a tool lower part and a tool upper part of a thermoform packaging machine, the method comprising the steps of:

providing a thermoform packaging machine comprising a controller and a film punch including a servo drive, the tool lower part, the tool upper part, and a lifting mechanism;

moving at least one of the tool lower part and the tool upper part with the lifting mechanism such that the tool upper part and the tool lower part approach each other; and detecting contact between the tool upper part and the tool lower part, the contact being detected by the controller through evaluation data of a measuring unit, wherein the measuring unit is at least one of a pressure sensor, an impact-sound sensor, a vibration sensor, and a governor that detects at least the current of a servo drive or of a servo motor of the servo drive.

7. The method according to claim 6, wherein the measuring unit is the governor for a servomotor of the servo drive of the film punch, and wherein based on the current consumption of the servomotor, the force progression of the force acting on at least one of the tool upper part and the tool lower part is detected.

8. The method according to claim 6, wherein the measuring unit is the pressure sensor, and wherein a measurement of force is carried out on at least one of the tool lower part and the tool upper part.

9. The method according to one of the claim 6, wherein the controller determines an end position for at least one of the tool lower part and the tool upper part.

10. A thermoform packaging machine comprising:

a film punch including a servo drive, a lever mechanism, a tool upper part and a tool lower part, wherein at least one of the tool upper part and the tool lower part is movable by the lever mechanism such that the tool upper part and the tool lower part approach each other;

a controller; and a measuring unit configured to detect a contact between the tool upper part and the tool lower part, wherein the servo drive comprises a servomotor, a governor and a spindle, and the spindle is a ball screw.

11. The thermoform packaging machine of claim 10 further comprising a sealing station, wherein said film punch is downstream of said sealing station.

12. The thermoforming packaging machine of claim 10, wherein said lever mechanism is disposed between said servo drive and said at least one of the tool upper part and the tool lower part.

13. The thermoforming packaging machine of claim 12, wherein said servo motor is drivingly engaged with said spindle, and said spindle is operably connected to a carriage, and wherein a rotation of said spindle causes a linear movement of said carriage, said linear movement of said carriage being guided by a vertical-orientated guide, and said linear movement of said carriage causes an operation of said lever mechanism.

* * * * *